US010125992B2

(12) United States Patent
Wada et al.

(10) Patent No.: US 10,125,992 B2
(45) Date of Patent: Nov. 13, 2018

(54) GAS TURBINE COMBUSTOR WITH ANNULAR FLOW SLEEVES FOR DIVIDING AIRFLOW UPSTREAM OF PREMIXING PASSAGES

(71) Applicant: Mitsubishi Hitachi Power Systems, Ltd., Yokohama, Kanagawa (JP)

(72) Inventors: Yasuhiro Wada, Yokohama (JP); Toshifumi Sasao, Yokohama (JP); Takeo Saito, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 617 days.

(21) Appl. No.: 14/540,123

(22) Filed: Nov. 13, 2014

(65) Prior Publication Data

US 2015/0135717 A1 May 21, 2015

(30) Foreign Application Priority Data

Nov. 15, 2013 (JP) ..... 2013-237305

(51) Int. Cl.
*F23R 3/28* (2006.01)
*F23D 11/40* (2006.01)
(Continued)

(52) U.S. Cl.
CPC ..... *F23R 3/286* (2013.01); *F23D 11/40* (2013.01); *F23D 14/70* (2013.01); *F23R 3/02* (2013.01);
(Continued)

(58) Field of Classification Search
CPC .... F23R 3/02; F23R 3/286; F23R 3/28; F23R 3/14; F23R 3/46; F23R 3/04; F23R 3/10; F23R 3/283; F23D 11/40; F23D 14/70
See application file for complete search history.

(56) References Cited

U.S. PATENT DOCUMENTS 5,983,642 A * 11/1999 Parker ..... F02C 7/222 239/403
6,634,175 B1 * 10/2003 Kawata ..... F23R 3/04 60/746
(Continued)

FOREIGN PATENT DOCUMENTS

EP 1 826 485 A2 8/2007
EP 2 527 738 A2 11/2012
(Continued)

OTHER PUBLICATIONS

European Search Report dated Apr. 14, 2015 (six (6) pages).

*Primary Examiner* — William H Rodriguez
*Assistant Examiner* — James McGlynn
(74) *Attorney, Agent, or Firm* — Crowell & Moring LLP

(57) ABSTRACT

A gas turbine combustor includes a plurality of fuel nozzles, a premixing plate, and a plurality of annular flow sleeves. The plurality of annular flow sleeves includes an inner annular flow sleeve and an outer annular flow sleeve. The plurality of annular flow sleeves is formed to divide an airflow passage into a plurality of flow passages including an inner and an outer circumferential flow passages. The airflow passage is formed around the plurality of fuel nozzles. The airflow passage extends from an upstream side of the plurality of fuel nozzles to fuel injecting ports of the fuel nozzles. The plurality of annular flow sleeves rectifies a flow of air in each of the flow passages and guiding the flow of air to the fuel injecting ports of the fuel nozzles.

6 Claims, 8 Drawing Sheets

(51) Int. Cl.

| | |
|---|---|
| ***F23D 14/70*** | (2006.01) |
| ***F23R 3/04*** | (2006.01) |
| ***F23R 3/10*** | (2006.01) |
| ***F23R 3/14*** | (2006.01) |
| ***F23R 3/26*** | (2006.01) |
| ***F23R 3/02*** | (2006.01) |
| ***F23R 3/46*** | (2006.01) |

(52) U.S. Cl.

CPC ..... *F23R 3/04* (2013.01); *F23R 3/10* (2013.01); *F23R 3/14* (2013.01); *F23R 3/26* (2013.01); *F23R 3/28* (2013.01); *F23R 3/283* (2013.01); *F23R 3/46* (2013.01)

(56) References Cited

U.S. PATENT DOCUMENTS

| | | | | |
|---|---|---|---|---|
| 6,813,889 | B2 | 11/2004 | Inoue et al. | |
| 7,360,363 | B2 * | 4/2008 | Mandai | F23R 3/14 60/737 |
| 7,780,151 | B2 * | 8/2010 | Carroni | F23D 14/02 261/118 |
| 9,951,956 | B2 * | 4/2018 | Valeev | F23R 3/286 |
| 2013/0025285 | A1 * | 1/2013 | Stewart | F02C 7/2365 60/740 |
| 2013/0139511 | A1 | 6/2013 | Sometani et al. | |

FOREIGN PATENT DOCUMENTS

| | | | |
|---|---|---|---|
| EP | 2 551 491 | A2 | 1/2013 |
| JP | 2003-148734 | A | 5/2003 |

* cited by examiner

CROSSA SECTION A- A

CROSS SECTION B-B

GAS TURBINE COMBUSTOR WITH ANNULAR FLOW SLEEVES FOR DIVIDING AIRFLOW UPSTREAM OF PREMIXING PASSAGES

BACKGROUND OF THE INVENTION

1. Field of the Invention

The present invention relates generally to a gas turbine combustor. More particularly, the invention is directed to a gas turbine combustor including a cluster-type burner that injects a fuel from a plurality of fuel nozzles into a plurality of premixing passages formed in a premixing plate, then after mixing in the premixing passages the injected fuel and a flow of air guided to fuel injecting ports of the fuel nozzles, supplies the mixed fuel and air to a combustion chamber, and burns the mixed fuel and air therein.

2. Description of the Related Art

In gas turbine combustor, emissions of nitrogen oxides (NOx), which are air pollutants, can be suppressed to a low level by using a premixed combustion scheme that forms a flame in a combustion chamber after the fuel and air have been premixed. Among known burners of the premixed combustion scheme are those of a coaxial jet flow combustion scheme in which a fuel and air are supplied as coaxial jet flows to a combustion chamber and burned therein. These burners are hereinafter referred to as cluster-type burners, an example of which is described in JP-2003-148734-A.

SUMMARY OF THE INVENTION

To adopt a cluster-type burner, it is structurally necessary to arrange fuel nozzles concentrically in several arrays in a circumferential direction. Therefore, flow passage resistance of combustion air is increased as the combustion air flows from an outer circumferential region into an inner circumferential region, and this increases the amount of combustion air flowing into the outer circumferential fuel nozzles of less resistance and reduces the amount of air flowing into the inner circumferential fuel nozzles. The reduction in the amount of air in the inner circumferential fuel nozzles will increase a mixture ratio of the fuel and air (this mixture ratio is hereinafter referred to as the fuel-air ratio), thus causing an increase in combustion temperature and hence an increase in NOx as well. In addition, a problem of reduced combustion stability will arise from instability of a flow rate of the air in certain positions.

For these reasons, it is common to control the fuel-air ratio by dividing the fuel supply system and setting appropriate supply rates of the fuel for the inner circumferential and outer circumferential fuel nozzles. The resulting increase in the number of fuel systems poses further problems such as an increased number of parts, increased manufacturing costs, and complicated maintenance.

The present invention has been created with the above problems in mind, and an object of the invention is to provide a gas turbine combustor including a cluster-type burner with a plurality of fuel nozzles arranged therein, the combustor being adapted to stabilize a combustion state by supplying a desired flow rate of air to inner circumferential and outer circumferential fuel nozzle sections.

In order to attain the above object, an aspect of the present invention is a gas turbine combustor including a cluster-type burner with a plurality of fuel nozzles arranged therein, the combustor further including at least one annular flow sleeve formed to divide an airflow passage extending from an upstream side of the fuel nozzles to fuel injecting ports of the fuel nozzles, into a plurality of flow passages and rectify and guide a flow of air in each of the flow passages.

This suppresses any differences in the amount of air at the fuel injecting ports of the inner circumferential and outer circumferential fuel nozzles due to pressure variations in the combustor or flow passage resistance of the fuel nozzles themselves. A desired amount of air can therefore be supplied to the fuel injecting ports of the fuel nozzles. The above annular flow sleeve arrangement is also effective for rectifying a flow of air in an axial direction of the burner section, and thus enables combustion stability to be enhanced. In addition, since the combustion state can be stabilized even without dividing a fuel supply system, a simplified fuel supply system can be formed by integrating fuel supply systems into one.

In the present invention, the desired amount of combustion air can be guided to the fuel injecting ports of the fuel nozzles and a desired fuel-air ratio can be stably obtained for each of the circumferential fuel nozzle arrays. This enhances the stability of the combustion state and enables NOx emissions to be reduced. Additionally a simplified fuel supply system can be formed by integrating fuel supply systems into one.

DESCRIPTION OF THE PREFERRED EMBODIMENTS

Hereunder, embodiments of the present invention will be described with reference to the accompanying drawings.

Figure 1A:
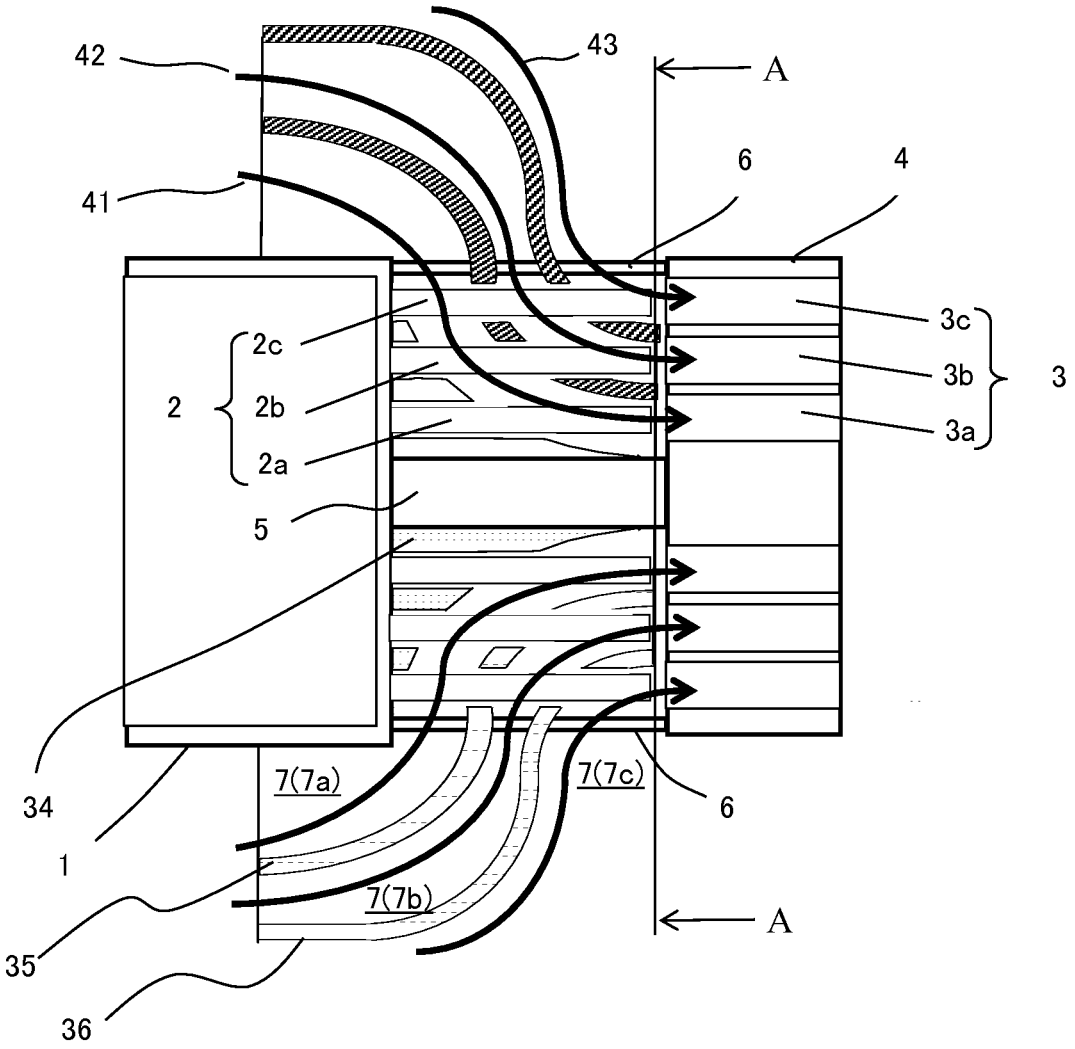
FIG. 1A is a sectional view that shows construction of a burner section of a gas turbine combustor according to a first embodiment of the present invention.
Figure 1B:
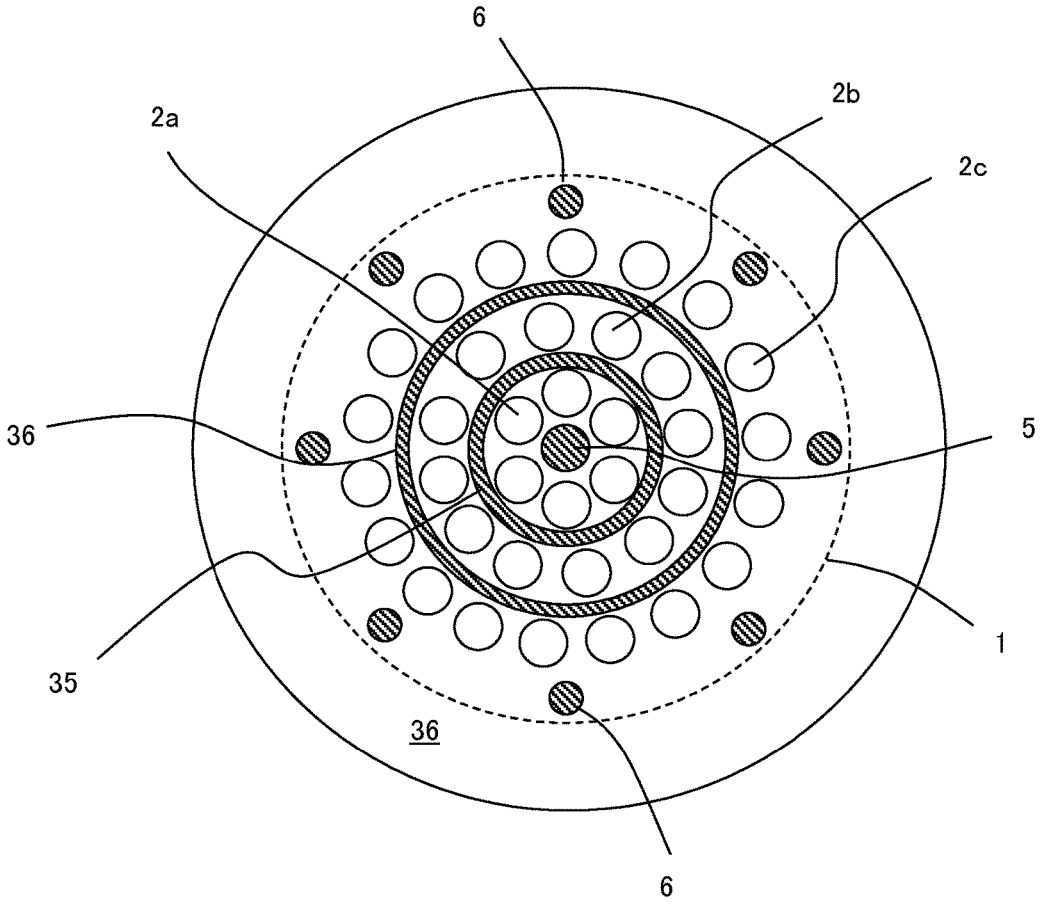
FIG. 1B is an external view of cross section A-A in FIG. 1A, viewed in the direction of the arrows.

FIGS. 1A and 1B show construction of a burner section of a gas turbine combustor according to a first embodiment of the present invention, FIG. 1A being a sectional view and FIG. 1B being an external view of cross section A-A in FIG. 1A, viewed in the direction of the arrows.

Referring to FIGS. 1A and 1B, the burner section of the gas turbine combustor is a cluster-type burner that includes a plurality of fuel nozzles 2 and a premixing plate 4 in which are formed a plurality of premixing passages 3 each positioned at a downstream side of one of the fuel nozzles 2. The plurality of fuel nozzles 2 are connected to an end face of a fuel nozzle header 1, and the premixing plate 4 is connected to the end face of a fuel nozzle header 1 via a central support rod 5 and a plurality of outer circumferential support rods 6. The plurality of fuel nozzles 2 include three arrays of fuel nozzles, namely an inner circumferential fuel nozzle 2*a*, a central fuel nozzle 2*b*, and an outer circumferential fuel nozzle 2*c*, that are arranged in concentric form and are equally spaced in a circumferential direction of the burner section. In association with the inner circumferential fuel nozzle 2*a*, the central fuel nozzle 2*b*, and the outer circumferential fuel nozzle 2*c*, the plurality of premixing passages 3 include an inner circumferential premixing passage 3*a*, central premixing passage 3*b*, and outer circumferential premixing passage 3*c*, respectively, that are spacedly arranged at equal intervals in the circumferential direction of the burner section. The premixing passages 3 are formed so that preferably at least one part of the premixing passages 3 inclines at a central axis thereof relative to an axial direction of the burner section and is constructed to promote mixing of a fuel and air by imparting an axial swirling force around a combustion chamber to a mixture flow of the fuel and air within the premixing passage 3.

In addition, the burner section of the gas turbine combustor includes, as its characteristic elements, an inner circumferential annular flow sleeve 34, a central annular flow sleeve 35, and an outer circumferential annular flow sleeve 36. These annular flow sleeves divide an airflow passage extending from an upstream side of the plurality of fuel nozzles 2 to fuel injecting ports of the fuel nozzles 2, into a plurality of flow passages 7, and rectify and guide a flow of air in each of the flow passages.

The inner circumferential annular flow sleeve 34 is constructed so as to pass through the central support rod 5 and the fuel nozzles 2, and is supported by the central support rod 5. In addition, the inner circumferential annular flow sleeve 34 abuts upon the end face of the fuel nozzle header 1 and is fixed thereto by welding or the like. The central annular flow sleeve 35 and the outer circumferential annular flow sleeve 36 are constructed so as to pass through the outer circumferential support rods 6, and are fixed to and retained by the outer circumferential support rods 6 by means of welding or the like.

The plurality of airflow passages 7 obtained from the division by the annular flow sleeves 34, 35, 36 include an inner circumferential airflow passage 7*a* formed by the division by the inner circumferential annular flow sleeve 34 and the central annular flow sleeve 35, a central airflow passage 7*b* formed by the division by the central annular flow sleeve 35 and the outer circumferential annular flow sleeve 36, and an outer circumferential airflow passage 7*c* formed by the division by the outer circumferential annular flow sleeve 36. The fuel injecting ports of the fuel nozzle 2*a* are positioned at a terminal portion of the inner circumferential airflow passage 7*a*, the fuel injecting ports of the fuel nozzle 2*b* are positioned at a terminal portion of the central airflow passage 7*b*, and the fuel injecting ports of the fuel nozzle 2*c* are positioned at a terminal portion of the outer circumferential airflow passage 7*c*.

In this way, the airflow passage in the burner section is divided into the plurality of airflow passages 7*a*, 7*b*, 7*c* for each array of the concentrically arranged fuel nozzles 2*a*, 2*b*, 2*c* by the inner circumferential annular flow sleeve 34, the central annular flow sleeve 35, and the outer circumferential annular flow sleeve 36, and the plurality of airflow passages guide the combustion air to the respective fuel injecting ports of the corresponding fuel nozzles 2.

Sizes and shapes of the annular flow sleeves 34, 35, 36 are determined so that in the airflow passages 7*a*, 7*b*, 7*c* formed by the annular flow sleeves 34, 35, 36, each annular flow sleeve supplies a desired amount of air to the fuel injecting ports of the relevant fuel nozzle 2*a*, 2*b*, or 2*c*, and so that a mixture ratio of the fuel and air, or a fuel-air ratio, takes a predetermined value.

In general, a diffusion flame formed by directly injecting a fuel into a combustion chamber has high flame stability because of a flame temperature higher than that of a premixed flame formed after the fuel and air have been mixed in advance. In contrast to this, the cluster-type burner as described in JP-2003-148734-A is low in flame stability, but reduces NOx emissions since the fuel that has been injected from a large number of concentrically arranged fuel nozzles is premixed with air before burned.

Figure 7:
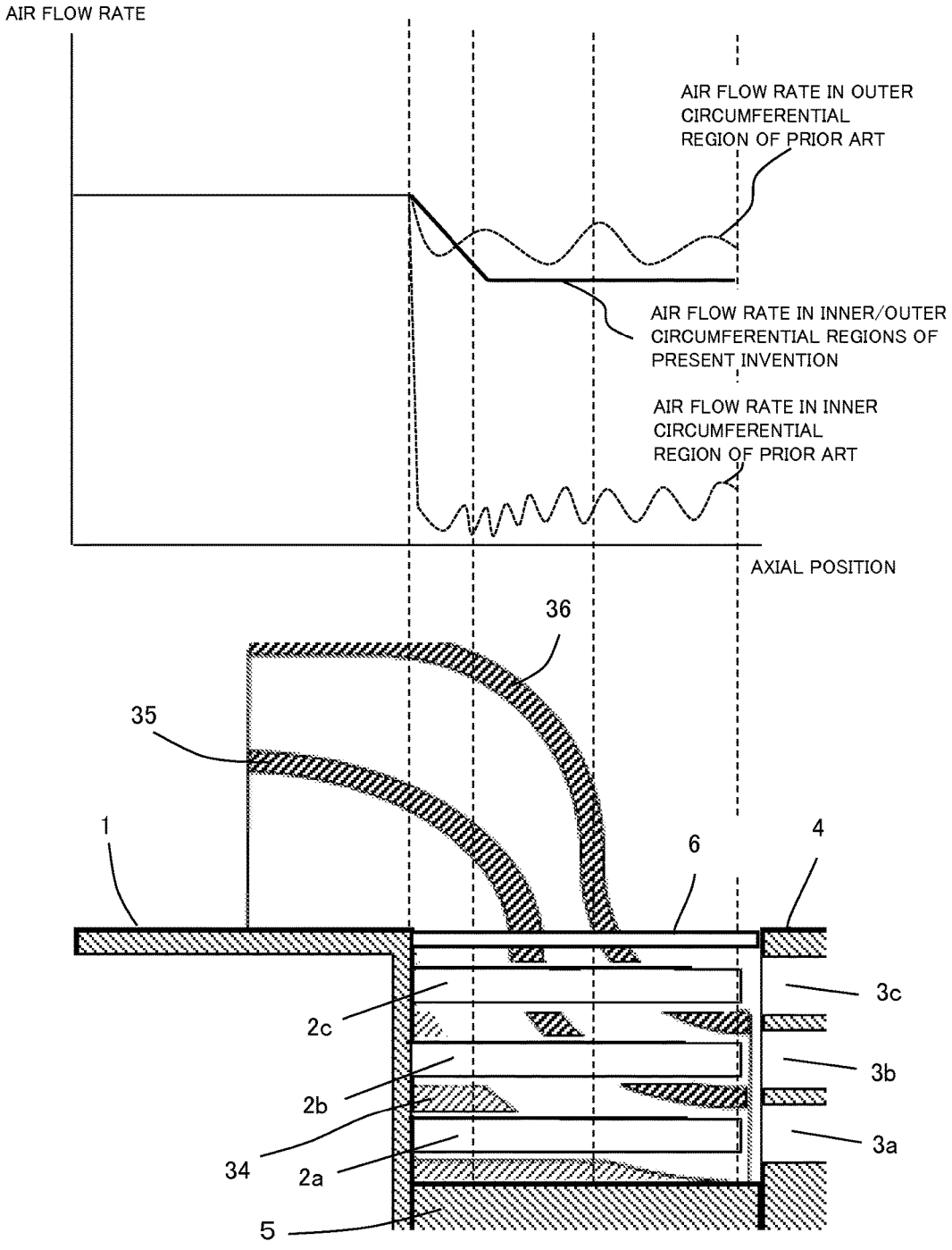
FIG. 7 is a diagram that shows trends in air flow rate changes on a comparative basis between the present invention and a conventional burner structure.

One of the reasons for the low flame stability in a cluster-type burner is that a change in the amount of air due to a change in an internal pressure of the combustor causes unstable mixing between the fuel from each fuel nozzle and the air. In addition, cluster-type burners need to have a large number of fuel nozzles in a limited space and hence to have multi-array nozzle construction, so that as shown in FIG. 7, outer circumferential fuel nozzles pose a flow passage resistance that develops a difference in a flow rate of combustion air between an outer circumferential side and an inner circumferential side, thereby reducing the flow rate of the combustion air flowing into the fuel nozzles positioned at the inner circumferential side, and reduce a velocity of the air as well. Consequently, the burner construction may further cause a change in the amount of air itself and this change may render a designed fuel-air ratio unobtainable. Moreover, if the amount of air is too small, an increase in NOx emissions due to an increase in fuel-air ratio is likely, and if the amount of air is too large, this is likely to deteriorate ignitability and result in unstable combustion.

The present embodiment shown in FIGS. 1A and 1B includes the annular flow sleeves 34, 35, 36 with a view to actively guiding air to the outer circumferential fuel nozzle 2*a* or the central fuel nozzle 2*b*. Thus, in the burner section of the combustor with the three arrays of fuel nozzles 2*a*, 2*b*, 2*c* shown in FIGS. 1A and 1B, the flow rate is governed in the inner circumferential airflow passage 7*a* formed by the inner circumferential annular flow sleeve 34 and the central annular flow sleeve 35, the combustion air 41 flows in a rectified condition through the inner circumferential airflow passage 7*a* and after this, is guided to the inner circumferential premixing passage 3*a*. In the inner circumferential premixing passage 3*a*, inner circumferential combustion air 41 for is mixed with the fuel injected from the inner circumferential fuel nozzle 2*a*, and then this mixture passes through the inner circumferential premixing passage 3*a* and becomes ignited and burned in the combustion chamber.

Similarly, a defined flow rate of central combustion air 42 flows in a rectified condition through the central airflow passage 7*b* formed by the central annular flow sleeve 35 and the outer circumferential annular flow sleeve 36, and is guided to the inner circumferential premixing passage 3*b*. At the same time, a defined flow rate of outer circumferential combustion air 43 flows in a rectified condition through the outer circumferential airflow passage 7*c* formed in an outer circumferential region of the outer circumferential annular flow sleeve 36, and is guided to the outer circumferential premixing passage 3*c*. The central combustion air 42 and outer circumferential combustion air 43 that have thus been guided to the respective annular flow sleeves are mixed with the fuel in the central and outer circumferential premixing passages 3*b* and 3*c*, respectively, and are ignited and burned in the combustion chamber.

Thus the present embodiment suppresses any differences in the amount of air at the fuel injecting ports of the inner circumferential and outer circumferential fuel nozzles due to pressure variations in the combustor or flow passage resistance of the fuel nozzles themselves, thus enabling the desired amount of air to be supplied to the fuel injecting ports of the fuel nozzles. The embodiment is also effective for rectifying the flow of air in the axial direction of the burner section, and hence enables combustion stability to be enhanced.

Figure 2:
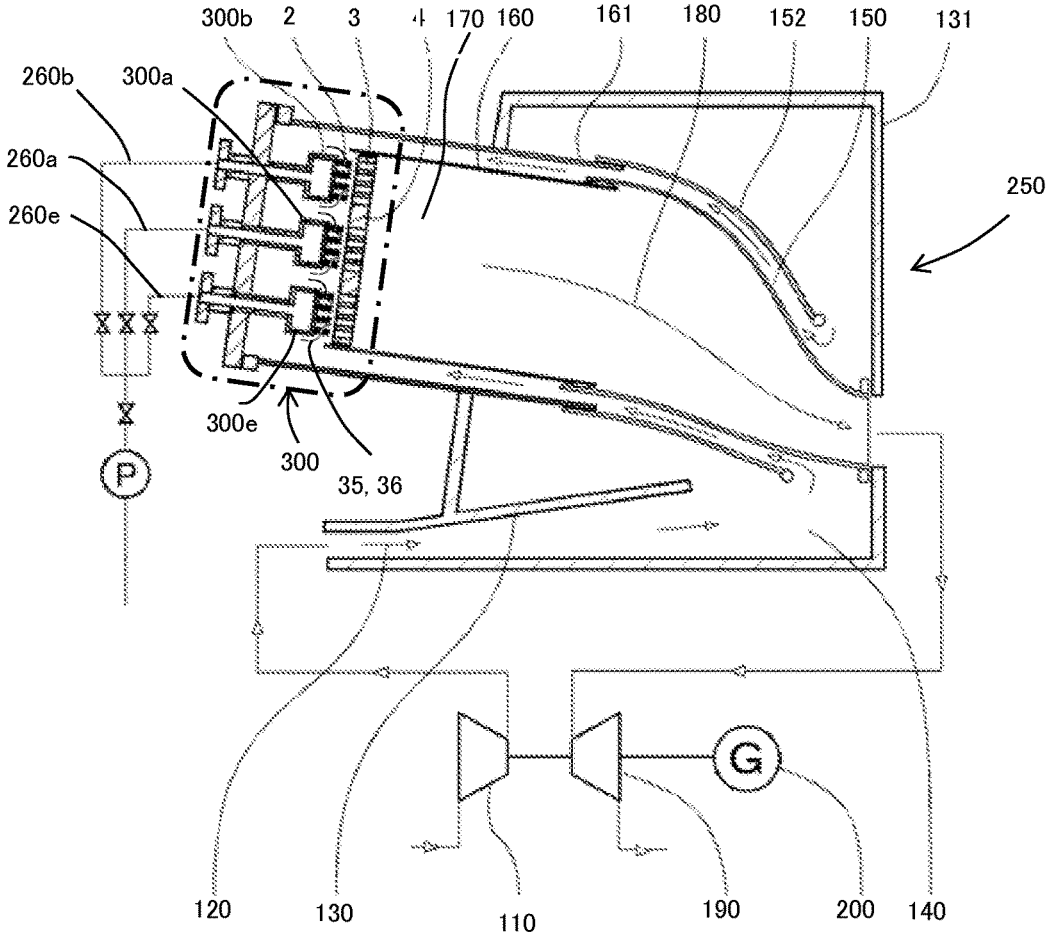
FIG. 2 is a schematic diagram showing an example of a gas turbine combustor to which the cluster-type burner of the first embodiment is applied.

FIG. 2 is a schematic diagram showing an example of a gas turbine combustor to which the cluster-type burner of the first embodiment is applied. FIG. 2 shows entire gas turbine equipment for a power generator plant, inclusive of the combustor.

High-pressure air 120 that has been introduced from an air compressor 110 is further introduced from a diffuser 130 of the combustor into a casing 140 present inside a casing 131, and then flows into a clearance between a transition piece 150 and a transition piece flow sleeve 152. After this, the air 120 flows through a clearance between a liner 160 and a liner flow sleeve 161 disposed concentrically with an outer surface of the liner, then reverses the flow, and mixes with the fuel injected from the burner section 300, thereby to form a flame inside the combustion chamber 170 internal to the liner and become a high-temperature high-pressure combustion gas 180.

The burner section 300, a multi-cluster-type burner equipped with seven cluster-type burners having the cluster-type burner construction shown in FIGS. 1A and 1B, includes a central cluster-type burner 300*a* and six cluster-type burners, 300*b* to 300*g*, that are concentrically arranged at equal intervals around the central cluster-type burner 300*a* (of the six cluster-type burners, only the uppermost cluster-type burner 300*b* and the second lowermost cluster-type burner 300*e* are shown in FIG. 2). The cluster-type burners 300*a* to 300*g* are supplied with fuel from respective fuel supply systems 260*a* to 260*g* (only the fuel supply systems 260*a*, 260*b*, 260*e* are shown in FIG. 2). For the sake of illustrative convenience in FIG. 2, fuel nozzles and premixing passages are shown in section in a concentric dual-array pattern. Likewise, central and outer circumferential annular flow sleeves are collectively shown as one annular flow sleeves, and an inner circumferential annular flow sleeve is omitted. Air that has flown from the fuel supply systems 260*a*-260*g* into the burner section 300 is mixed, in the premixing passages 3 (see FIG. 1A) of the premixing plate 4, with the fuel injected from the fuel nozzles 2 (see FIGS. 1A and 1B) of the cluster-type burners 300*a*-300*g*, and then supplied to the combustion chamber 170.

The combustion gas 180 that has thus been generated in the combustor is introduced from the transition piece 150 into a turbine 190. In the turbine 190, a certain amount of work arises from adiabatic expansion of the high-temperature high-pressure combustion gas 180. The turbine 190 converts the generated amount of work into rotational force of a shaft and drives a generator 200. This rotational force of the shaft can also be used to rotate another compressor instead of the generator 200 and thus to operate the gas turbine as a motive power source for compressing fluids.

Figure 3:
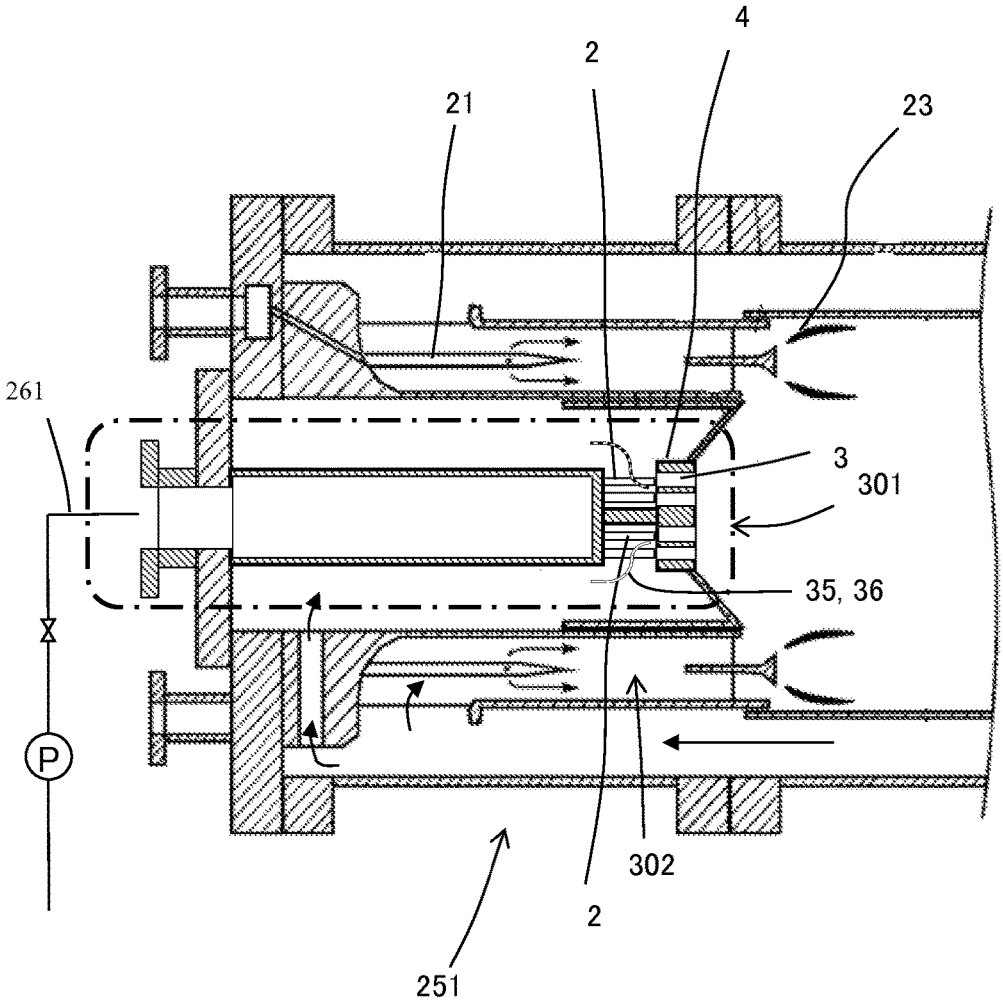
FIG. 3 is a schematic diagram showing another example of a gas turbine combustor to which the cluster-type burner of the first embodiment is applied.

FIG. 3 is a schematic diagram showing another example of a gas turbine combustor to which the cluster-type burner of the first embodiment is applied. In this example of application, the combustor 251 uses a central pilot burner as the cluster-type burner 301 of the present embodiment, and an outer circumferential main burner as a general premixing burner 302 that includes a fuel nozzle 21 and forms a premixed flame 23. Fuel is supplied from a fuel supply system 261 to the cluster-type burner 301. For the sake of illustrative convenience in FIG. 3, fuel nozzles and premixing passages are also shown in section in a concentric dual-array pattern. Likewise, central and outer circumferential annular flow sleeves are collectively shown as one annular flow sleeve, and an inner circumferential annular flow sleeve is omitted.

In the combustors 250 and 251 shown as applications in FIGS. 2 and 3, even without dividing the fuel supply system into a plurality of systems for the cluster-type burners 300*a*-300*g* or 301, disposing the annular flow sleeves enables a desired amount of combustion air to be conducted to the fuel injecting ports of each fuel nozzle and the desired fuel-air ratio to be stably obtained for each circumferential array of fuel nozzles. This in turn enables the fuel supply system to be simplified by either integrating the fuel supply systems 260*a*-260*g* (see FIG. 2) into one, or adopting the integrated fuel supply system 261 (see FIG. 3), for each cluster-type burner. The above disposition of the annular flow sleeves also enables stability of a combustion state to be improved and hence, NOx emissions to be reduced because of premixing.

Figure 4:
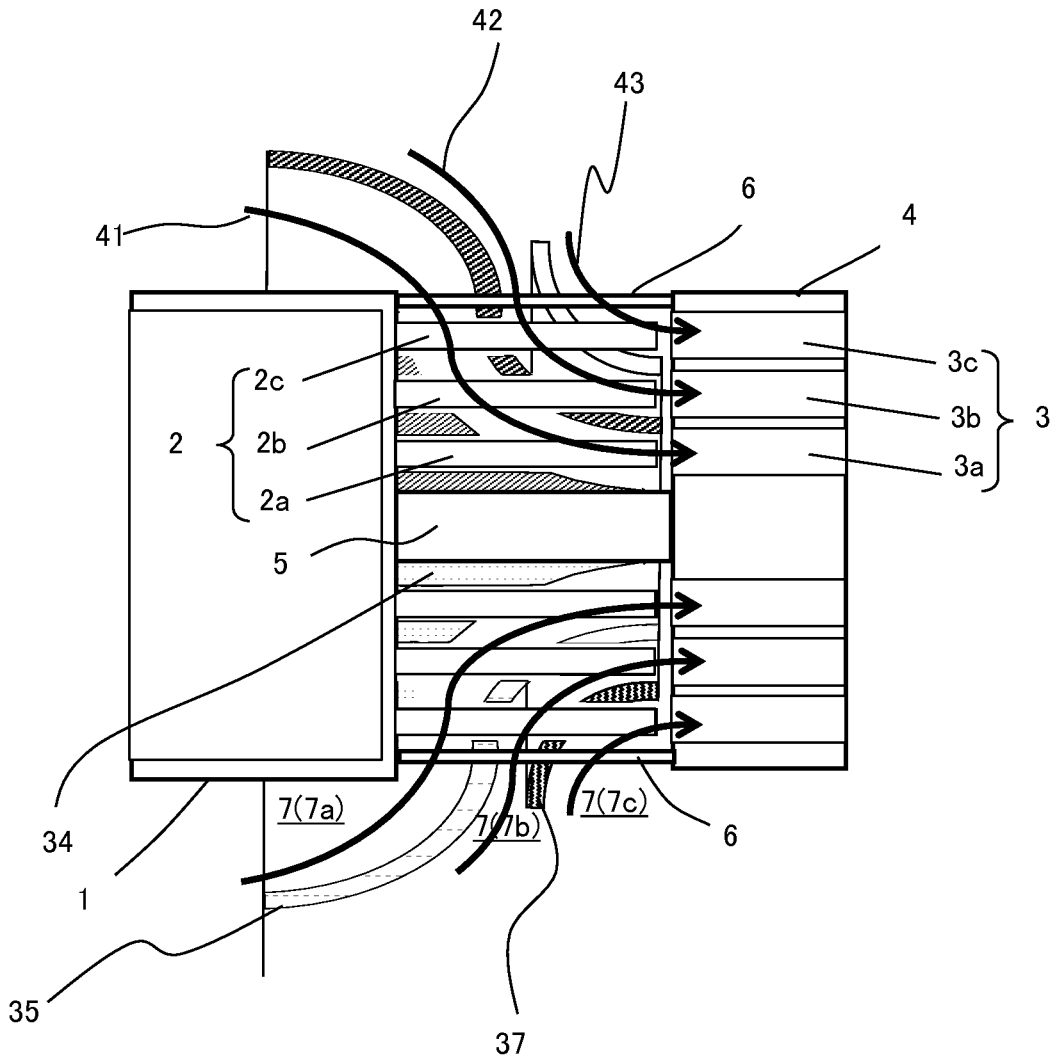
FIG. 4 is a sectional view that shows construction of a burner section of a gas turbine combustor according to a second embodiment of the present invention.

A second embodiment of the present invention is described below using FIG. 4. FIG. 4 is a sectional view similar to that of FIG. 1A, showing construction of a burner section of a gas turbine combustor according to the second embodiment.

Referring to FIG. 4, the burner section of the combustor according to the second embodiment includes a compact annular flow sleeve 37 at an outer circumferential side, instead of the outer circumferential annular flow sleeve 36 in FIG. 1A. An extension of the outer circumferential annular flow sleeve 37 (a second annular flow sleeve) that extends toward an upstream side is shorter than that of a central annular flow sleeve 35 (a first annular flow sleeve), so that the extension in the upstream side is also shorter than that of the outer circumferential annular flow sleeve 36 in FIG. 1A and the outer circumferential annular flow sleeve 37 is reduced in outside diameter as well. These geometric characteristics of the burner section make a radial size of the burner suppressible and thus enable a reduction in installation space requirements. Only the outer circumferential fuel nozzle 2*c* acts as flow passage resistance to the air that flows into the fuel injecting ports of the central fuel nozzle 2*b*, and the flow passage resistance is low relative to that of the inner circumferential fuel nozzle 2*a*. Therefore, substantially the same advantageous effects as in the embodiment of FIG. 1A can be obtained by providing a clearance greater than in the first embodiment of FIG. 1A, between the central annular flow sleeve 35 and the compact outer circumferential annular flow sleeve 37, and controlling the flow rate of the air in the outer circumferential and central regions.

Figure 5:
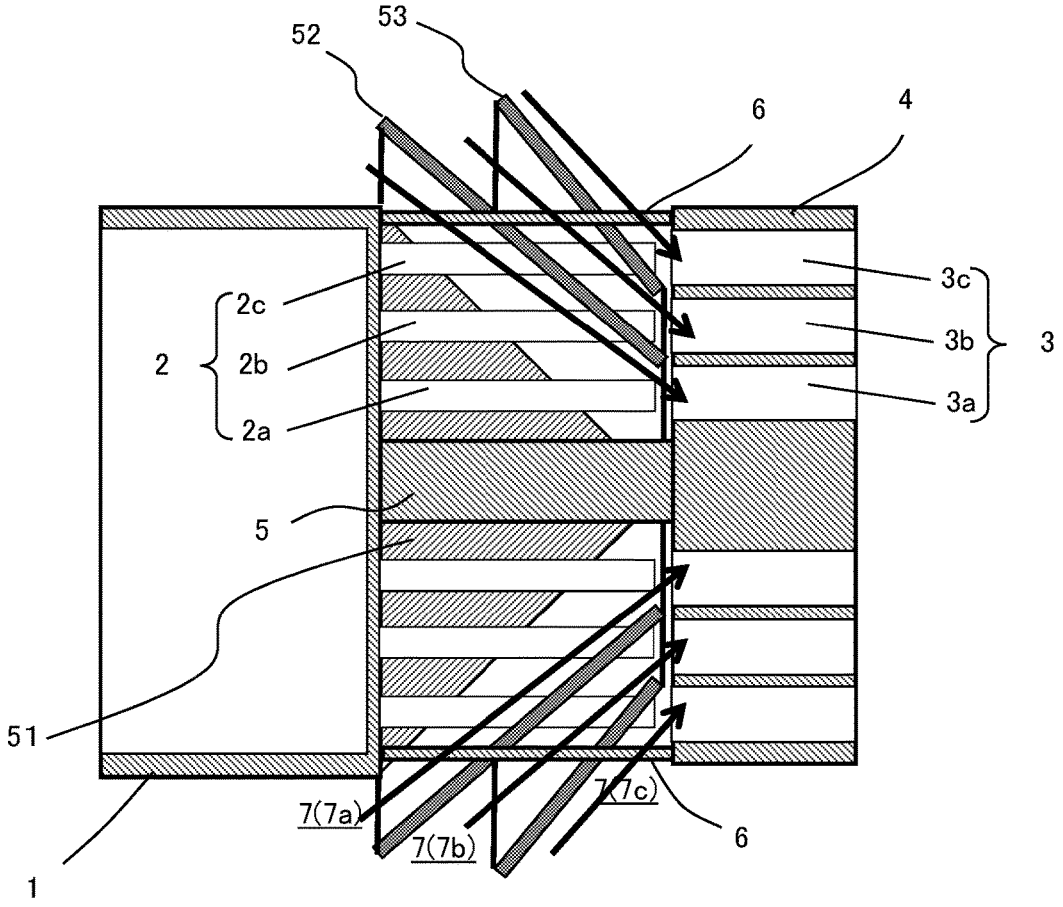
FIG. 5 is a sectional view that shows construction of a burner section of a gas turbine combustor according to a third embodiment of the present invention.

A third embodiment of the present invention is described below using FIG. 5. FIG. 5 is a sectional view similar to that of FIG. 1A, showing construction of a burner section of a gas turbine combustor according to the third embodiment.

In the present embodiment, when an inner circumferential annular flow sleeve 51, a central annular flow sleeve 52, and an outer circumferential annular flow sleeve 53 are viewed in axial section, these annular flow sleeves are of a simple linear shape, not such a curvilinear one as in FIG. 1. Accordingly, frictional resistance of the air which flows along the annular flow sleeves 51, 52, 53 is reduced, which then leads to a suppressed change in fuel-air ratio and enables more stable combustion and hence, reduction in manufacturing costs of the annular flow sleeves.

Figure 6A:
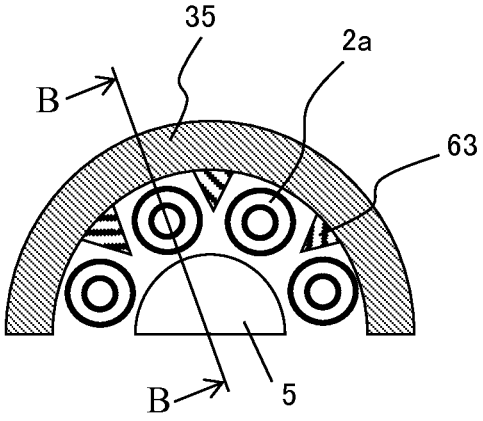
FIG. 6A is a sectional view that shows construction of a burner section of a gas turbine combustor according to a fourth embodiment of the present invention.
Figure 6B:
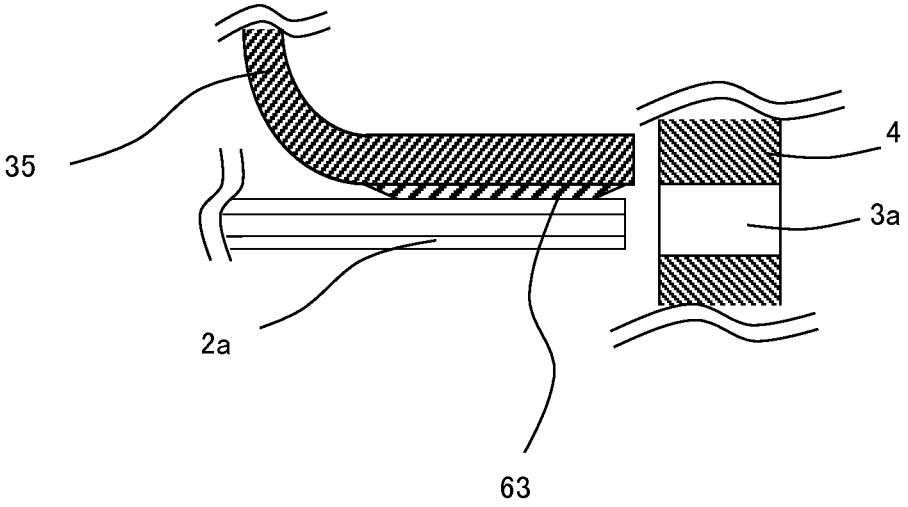
FIG. 6B is an external view of cross section B-B in FIG. 6A, viewed in the direction of the arrows.

A fourth embodiment of the present invention is described below using FIGS. 6A and 6B. FIG. 6A is an external view equivalent to an upper half of the central support rod 5 and central guide vane 35 of the burner section in FIG. 1B. FIG. 6B is an external view of cross section B-B in FIG. 6A, viewed in the direction of the arrows.

The present embodiment is characterized by the fact that in addition to the annular flow sleeve 35, a protruding vane 63 for rectifying an axial flow of combustion air is disposed on an inner circumferential surface of the annular flow sleeve 35, near a downstream end of this annular flow sleeve. The protruding vane 63, as shown, is a triangular vane whose vertex as viewed in transverse section faces toward a central axis of the vane. Mounting the triangular vane 63 in plurality and spacing the plurality of triangular vanes 63 in a circumferential direction and in parallel with respect to the axial direction allows the axial flow of the combustion air to be rectified and guided to the fuel injecting ports of the fuel nozzles 2 at which the respective flow passages 7 are positioned. While an example of disposing the protruding vane 63 on the inner circumferential surface of the annular flow sleeve 35 is shown in FIGS. 6A and 6B, if a similar protruding vane is disposed on an inner circumferential surface of the central annular flow sleeve 36, near a downstream end of the vane, this enables substantially the same advantageous effects to be obtained. Such a protruding vane may be further disposed on outer circumferential surfaces of the annular flow sleeves 34, 35, 36, near downstream ends of these vanes.

In addition, if the premixing passage 3 is inclined with respect to the axial direction to impart a swirling force to the mixture flow of the fuel and air, mounting the protruding vane 63 at an appropriate angle with respect to the axial direction according to the particular inclination of the premixing passage 3 will enable a swirling angle to be imparted to the combustion air before it enters the premixing passage 3, and will thus enable the air to be even more efficiently mixed with the fuel axially injected from the fuel nozzles 2.

In the above embodiments, the fuel nozzles have been disposed in three arrays concentrically and the inner circumferential annular flow sleeve 34, the central annular flow sleeve 35, and the outer circumferential annular flow sleeve 36 have been provided to form one airflow passage for each of the arrays by division. The number of airflow passages formed by division, however, does not always need to match the number of fuel nozzle arrays. Alternatively, the number of concentric arrays of the fuel nozzles may be other than three. The number of arrays can be two or four, for example. In this case, it will be necessary at least to arrange an appropriate number of annular flow sleeves according to the particular number of concentric arrays of the fuel nozzles and form one airflow passage for each of the arrays by division.

What is claimed is:

1. A gas turbine combustor comprising:

a plurality of fuel nozzles concentrically arranged in a first multi-array in a radial direction with respect to a centerline of the first multi-array, and spaced in a circumferential direction with respect to the centerline of the first multi-array, and having a plurality of fuel injecting ports formed to axially open with respect to the centerline of the first multi-array at a plurality of respective tip ends of the plurality of fuel nozzles;

a premixing plate in which are formed a plurality of premixing passages each positioned at a downstream side of a corresponding one of the plurality of fuel nozzles and spaced in the circumferential direction and concentrically arranged in a second multi-array in the radial direction to axially align with each of the plurality of fuel nozzles, injected fuel from the plurality of fuel nozzles being mixed with air in the plurality of premixing passages before being supplied to a combustion chamber and burnt therein; and a plurality of annular flow sleeves including an inner annular flow sleeve and an outer annular flow sleeve and arranged at an upstream side of the plurality of premixing passages and formed to extend from an upstream side of an airflow passage around the plurality of fuel nozzles up to the plurality of fuel injecting ports of the plurality of fuel nozzles, wherein the plurality of annular flow sleeves are configured to divide the airflow passage around the plurality of fuel nozzles at the upstream side of the plurality of premixing passages, into a plurality of flow passages including an inner circumferential flow passage and an outer circumferential flow passage for respective radial arrays from a plurality of radial arrays of the plurality of fuel nozzles concentrically arranged, and wherein a first radial array from the plurality of radial arrays is disposed radially inward of a second radial array from the plurality of radial arrays, and the plurality of annular flow sleeves rectifying a flow of air in each of the plurality of flow passages and guiding the flow of air to the plurality of fuel injecting ports of the plurality of fuel nozzles.

2. The gas turbine combustor according to claim 1, wherein:

sizes and shapes of the plurality of annular flow sleeves are determined so that a mixture ratio of air and fuel injected from the plurality of fuel nozzles takes a predetermined value in each of the plurality of flow passages formed by the plurality of annular flow sleeves.

3. The gas turbine combustor according to claim 1, wherein:

the plurality of annular flow sleeves comprise the inner annular flow sleeve and the outer annular flow sleeve, the inner annular flow sleeve guiding air to only a first portion of the plurality of fuel injecting ports of the plurality of fuel nozzles positioned at an inner circumferential side, the outer annular flow sleeve guiding air to a second portion of the plurality of fuel injecting ports of the plurality of fuel nozzles positioned at an outer circumferential side, an extension of the outer annular flow sleeve that extends toward the upstream side of the plurality of premixing passages is shorter than an extension of the inner annular flow sleeve, the outer annular flow sleeve being reduced in outside diameter.

4. The gas turbine combustor according to claim 1, wherein:

the plurality of annular flow sleeves are configured to each have a linear shape when viewed in axial section with respect to the centerline of the first multi-array, thereby reducing frictional resistance of air which flows along the plurality of annular flow sleeves.

5. The gas turbine combustor according to claim 1, wherein:

a plurality of protruding vanes spaced from each other in the circumferential direction are disposed on an inner circumferential surface of at least one of the plurality of annular flow sleeves near a downstream end of the at least one of the plurality of annular flow sleeves, and the plurality of protruding vanes rectify a property of air flowing along the at least one of the plurality of annular flow sleeves, and guide the rectified flow of air to the plurality of fuel injecting ports of the plurality of fuel nozzles positioned in respective flow passages from the plurality of flow passages.

6. The gas turbine combustor according to claim 5, wherein:

at least one of the plurality of premixing passages is inclined relative to an axial direction with respect to the centerline of the first multi-array, and the plurality of protruding vanes are mounted to be inclined relative to the axial direction according to the inclination of the at least one of the plurality of premixing passages, thereby imparting a swirling angle to combustion air before the combustion air enters the at least one of the plurality of premixing passages.

* * * * *